US005588546A

United States Patent [19]

Farside

[11] Patent Number: 5,588,546

[45] Date of Patent: Dec. 31, 1996

[54] CLOSURE WITH STAY-OPEN LID

[75] Inventor: Nicholas Farside, Lancaster, Pa.

[73] Assignee: Kerr Group, Inc., Lancaster, Pa.

[21] Appl. No.: 249,769

[22] Filed: May 26, 1994

[51] Int. Cl.[6] ..... B65D 43/14

[52] U.S. Cl. ..... 215/237; 215/330; 220/335

[58] Field of Search ..... 215/235, 237, 215/244, 245, 307, 330, 331; 220/254, 259, 291, 334, 335, 337, 338, 339

[56] References Cited

U.S. PATENT DOCUMENTS

| | | | |
|---|---|---|---|
| 3,131,824 | 5/1964 | Van Baarn | 215/235 X |
| 3,752,371 | 8/1973 | Susuki et al. . | |
| 3,933,271 | 1/1976 | McGhie . | |
| 4,158,902 | 6/1979 | Chernack et al. . | |
| 4,220,248 | 9/1980 | Wilson et al. . | |
| 4,291,818 | 9/1981 | Nozawa et al. | 220/335 |
| 4,346,810 | 8/1982 | Kneissl . | |
| 4,386,714 | 6/1983 | Roberto et al. . | |
| 4,423,811 | 1/1984 | Knapp . | |
| 4,457,458 | 7/1984 | Heinol . | |
| 4,487,324 | 12/1984 | Ostrowsky . | |
| 4,503,991 | 3/1985 | Joyce . | |
| 4,545,495 | 10/1985 | Kinsley . | |
| 4,615,462 | 10/1986 | Sacherer et al. . | |
| 4,625,898 | 12/1986 | Hazard . | |
| 4,635,823 | 1/1987 | Stull . | |
| 4,700,858 | 10/1987 | Bennett . | |
| 4,759,455 | 7/1988 | Wilson . | |
| 4,778,071 | 10/1988 | Fillmore | 215/237 |
| 4,793,502 | 12/1988 | Beck . | |
| 4,838,441 | 6/1989 | Chernack | 215/216 |
| 4,848,612 | 7/1989 | Beck . | |
| 4,917,253 | 4/1990 | Dutt | 215/235 |
| 5,088,612 | 2/1992 | Storar et al. . | |
| 5,358,130 | 10/1994 | Mengeu et al. | 215/258 |

FOREIGN PATENT DOCUMENTS

| | | |
|---|---|---|
| 4123732 | 1/1992 | Germany . |

*Primary Examiner*—Stephen K. Cronin
*Attorney, Agent, or Firm*— Kenyon & Kenyon

[57] ABSTRACT

A closure has a stay-open lid. A nib on the lid, which frictionally engages the walls of a void on the base, allows the lid to stay-open unless forcibly closed by the user.

26 Claims, 2 Drawing Sheets

CLOSURE WITH STAY-OPEN LID

FIELD OF THE INVENTION

The present invention relates to a closure for a container. In particular, it relates to a closure with a stay-open lid. The stay-open lid may be accomodated on, for example, living-hinge closures or two-piece closures. The closure may also have a dripless outlet. The stay-open feature is attained in part by the use of a nib on the closure's lid which engages a void on the closure's base. The frictional fit between the nib and the sides of the void keep the lid up until the user chooses to close the lid on top of the base. The dripless outlet is attained in part by using a predetermined angle on the frustum creating the outlet.

BACKGROUND OF THE INVENTION

U.S. Pat. No. 5,088,612 to Storar et al. describes a closure with engaging finger members which tend to hold the lid in an open position. The engaging member may tend to flex due to its length. The engagement, which takes place only at the end, may limit the usefulness.

U.S. Pat. No. 4,625,898 to Hazard describes a closure with a cam system that allows a lid to pivot about a hinge between an open position and a closed position. Similarly, U.S. Pat. No. 4,220,248 to Wilson, et al., describes a closure with cam and spring elements that hold the lid open. While these may be effective to hold the lid open, the complexity of their designs increases the cost of the closures.

U.S. Pat. No. 4,635,823 to Stull provides an example of a type of spout which is often found on closures such as these. The spout design of these closures makes them susceptible to spillage and dripping. Thus, there is a need for a spout which may dispense the contents of a container with a minimum of spillage and dripping.

There is a need for a closure with a reliable stay-open lid that may be used with living hinge closures or with two-piece closures. There is also a need for a closure whose spout is relatively dripless.

SUMMARY OF THE INVENTION

The present invention is directed to a closure with a stay-open lid. The closure may also have a dripless feature. The closure includes a base, a lid and a hinge connecting the two. The hinge may be, for example, a living hinge or a two-piece hinge. The base includes a wall, a depending skirt, an outlet which may be frustal for dispensing the contents of the container, and a void adjacent the living hinge. The lid includes a lid wall, a depending skirt, a plug to close the outlet when the lid is closed, and a nib which frictionally engages the void so as to hold the lid in an open position. This nib may be, for example, in the shape of a hemisphere or a rectangular solid. A closure according to the present invention may also include an annular outlet separating the outlet from the base wall. A closure including such an annular outlet may provide a better fit for the plug in certain applications.

The outlet in the present invention may be frustal, in which case it extends away from the base at predetermined angles. A closure including such an outlet minimizes the dripping which was seen with known closures.

An annular bead may be placed around the inside circumference of the base to allow a snap-fit attachment to a container neck.

To facilitate ease of opening, the front of the closure may have an indentation by which the user may better grasp the edge of the skirt which depends from the lid. In this way, the lid may be flipped up to the open position about the living hinge.

Other features and advantages will hereinafter appear to those of ordinary skill in the art. For simplicity, the hinge shown in the figures is a living hinge, but other types, including two-piece hinges, may also be used.

DETAILED DESCRIPTION

Figure 1:
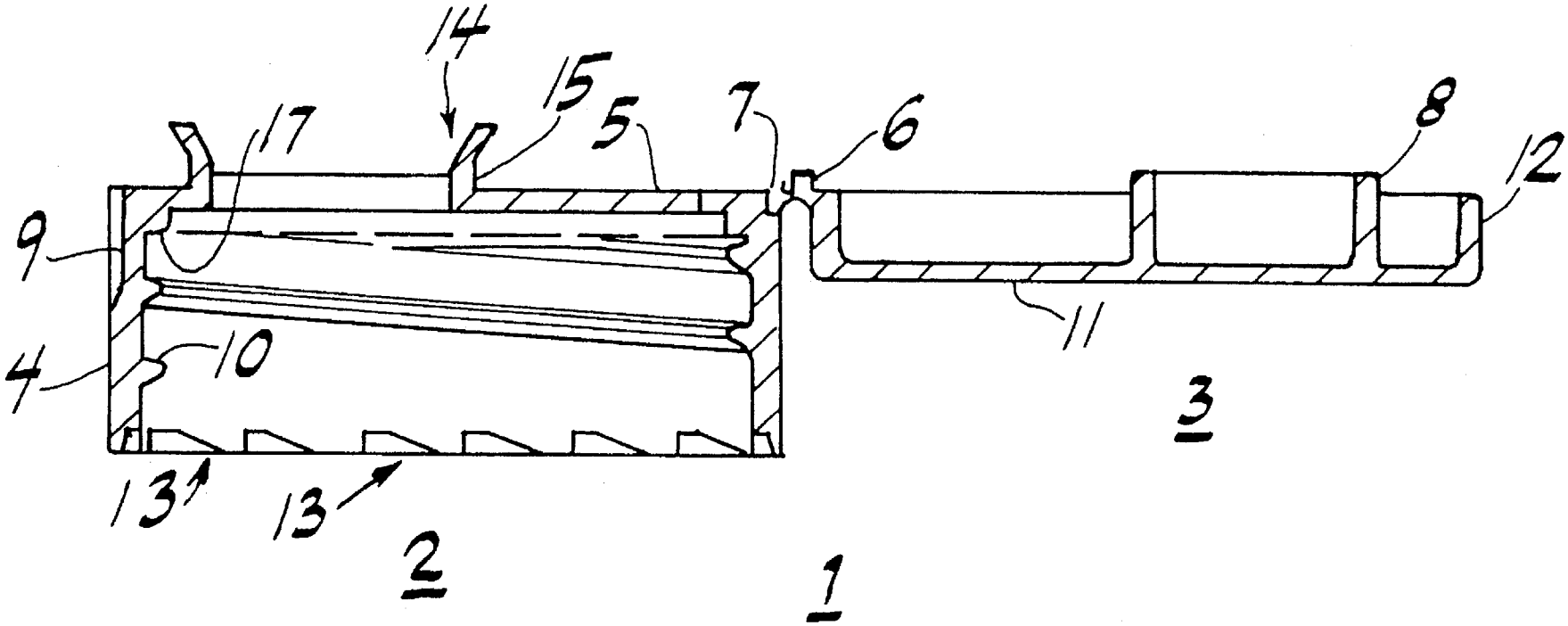
FIG. 1 shows a side section of an embodiment of the present invention.
Figure 2:
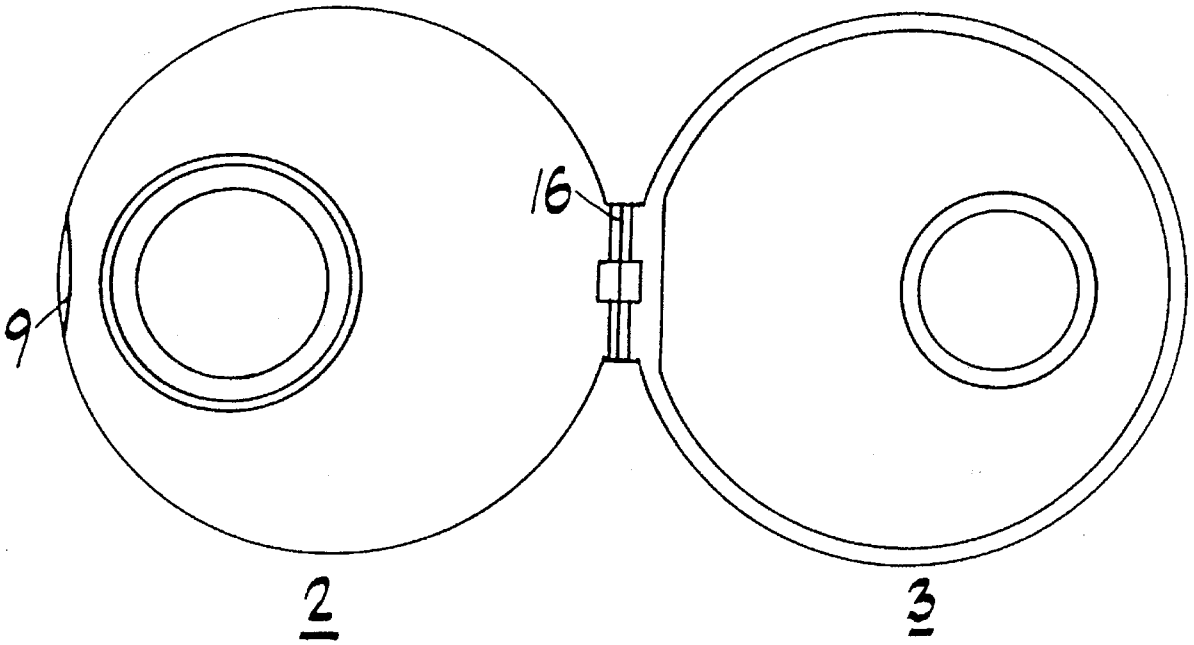
FIG. 2 shows a top view of an embodiment of the present invention.

FIG. 1 shows a side view of an embodiment of the present invention. A closure 1 according to the present invention includes a base 2 and a lid 3. As shown in FIG. 2, a living hinge 16 connects the base 2 and the lid 3. A two-piece hinge (not shown) may also be used. To present a pleasing appearance, the mostly cylindrical exterior of the base 2 is generally flush with the mostly cylindrical exterior of the lid 3. In this way, when the lid is in the closed position, a generally singular cylindrical surface is evident to the consumer.

The base 2 has a base wall 5, from which depends a first skirt 4. This skin 4 may have threads 10 on its interior, allowing for the threaded engagement of the closure 1 to the neck of a container (not shown). Alternatively, the skirt 4 may have an annular bead located around an inner circumference, thus allowing for a snap-fit attachment to a container neck. The circumferential edge of the first skin 4 may further include a plurality of ratchets 13 extending into its interior.

The base wall 5 has an opening through which the contents of the container may be dispensed. Circumferentially surrounding this opening may be an outwardly angled frustum which forms a frustal outlet 14. However, it is not necessary that the outlet be frustal. If a frustal outlet is chosen, the angle at which this frustum extends from the base wall 5 is predetermined to minimize dripping. For example, an angle of approximately 30 degrees from an axis normal to the base wall 5 has been found to significantly reduce spillage and dripping for most liquids used in these containers. The outlet 14, which may be frustal, may be raised above the base wall 5 a set distance by the interposition of an annular outlet 15 between the frustal outlet 14 and the base wall 5. This annular outlet 15 surrounds the opening in the base wall 5, and an inner edge of the annular outlet 15 is coupled to the edge of the opening while an outer edge of the annular outlet 15 is coupled to an edge of the outlet 14. Typically, if a frustal outlet is chosen, the edge of the frustal outlet 14, with which the edge of the annular outlet 15 is coupled, would be the circumferential edge of the frustum at its smallest radius.

For ease in flipping the lid 3 to its open position, an indentation 9 may be provided on the exterior of the first skirt 4 in an area diametrically opposite to the hinge 16, as is shown in FIG. 2. This indentation 9 generally forms a short chord in what may be otherwise a generally circular first skirt 4. This indentation 9 is also present in the area of the base wall 5 which is coextensive with the indentation in the first skirt. No corresponding indentation is present in the lid. In this way, a user may achieve a positive grasp on the lid 3, in the area directly above the indentation 9. This allows the user to firmly flip the lid 3 to its open position.

Alternatively, a portion of the lid 3 may be manufactured such that it extends beyond the first skirt 4. That is, the area of the lid wall 11 may be larger than the area of the cross-section of the first skirt 4.

Figure 3:
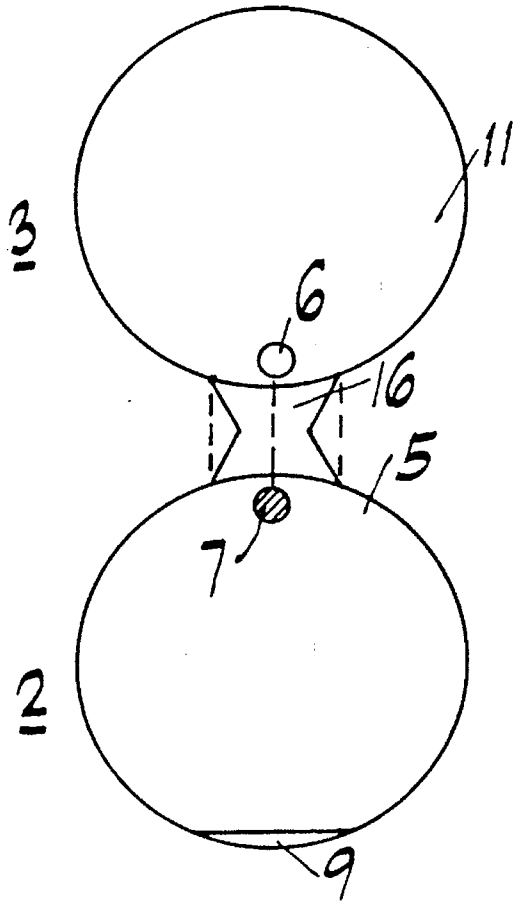
FIG. 3 shows a top view of another embodiment of the present invention which depicts a different type of living hinge.

The base 2 also includes a void 7 in a volume of the base wall 5 adjacent to the first skirt 4 and the hinge 16. For example, if a living hinge is used, the living hinge 16 may have two separate sections, and the void 7 may then be conveniently placed in the portion of the base wall 5 between these two portions. Alternatively, in the case of a single piece living hinge 16, the void 7 may be placed directly in front of the hinge 16. It would also be placed in front of the hinge if the hinge were in the shape of a butterfly, as shown in FIG. 3. Of course, this embodiment is not to be confused with the so-called butterfly hinge. In all cases, the void 7 may, for example, be roughly hemispherical or may be in the shape of a rectangular solid.

The lid 3 includes a lid wall 11 from which a second skirt 12 depends. A nib 6 on the lid 3 frictionally engages the walls of the void 7. The nib 6 may be a small mass formed on the edge of the living hinge 16 or on the edge of the second skirt 12. The nib 6 may also, for example, have the rough shape of a hemisphere, rectangular solid, and so on, with the primary constraint being that the nib 6 must fit snugly into the void 7. Clearly, the lid 3 is considered closed when the nib 6 is snugly inside the void 7. Likewise, the lid 3 is considered open when the nib 6 is outside the void 7. In either position, there must be enough frictional resistance to require the user to exert a certain amount of effort in order to flip the lid 3 to the opposite position. If the nib 6 is inside the void 7, effort is required to pull it out. If the nib 6 is outside the void 7, the nib 6 provides resistance to movement of the lid 3, i.e., the lid 3 stays open unless it is forced closed.

The lid 3 is further provided with an annular plug 8 depending from the lid wall 11 and extending in the same direction as the second skirt 12. This annular plug 8 engages the outlet 14, which may be frustal, and the annular outlet if one is provided, so as to prevent the removal of the contents of the container when the lid is closed. The cross-sectional area of the annular plug 8 is preferably slightly less than that of the opening in the base wall. This ensures a close frictional fit and thus a good seal.

To further achieve a superior seal to the neck of the container, an annular lip 17 is provided. The annular lip 17 is generally positioned in the interior of the base 2, in the circumferential corner where the first skirt 4 and the base wall 5 intersect. When the closure 1 is then, for example, screw-threaded on to a container neck (not shown), the circumferential edge of the container neck contacts the annular lip 17, creating a superior seal.

A closure is provided which has a stay-open feature. The closure may also have a dripless feature. The closure may have an outlet shape which has been found to possess superior qualities with regard to avoiding dripping and spillage. A nib on the lid, which frictionally engages the walls of a void on the base, allows the lid to stay-open unless forcibly closed by the user. The closure may also be made irremovable.

Those skilled in the art will understand that the various optional features of the disclosed closure may be combined in any number of variations without departing from the scope of the present invention. In addition, while the invention has been described in regard to a circular closure which is screwed on to a container, those skilled in the art will recognize that a closure according to the present invention may be any shape and that the scope of the invention is to be limited only be the claims appended hereto.

What is claimed is:

1. A closure with a stay-open lid, comprising:

(a) a base including:

(i) a base wall having an opening thereon and an outer periphery;

(ii) a first skirt depending from the periphery of the base wall, having an outer edge formed at the juncture of the base wall outer periphery and the skirt;

(iii) an outlet coupled to the base wall and in fluid communication with the opening in the base wall;

(b) a lid including:

(iv) a lid wall;

(v) a second skirt depending from the periphery of the lid wall;

(vi) a plug depending from the lid wall, the plug being received in the outlet when the lid is in a closed position;

(vii) a nib extending from an edge of the second skirt, the nib being received in a void formed at the outer edge of the base skirt when the lid is in a closed position on the base; and (c) a hinge connecting the base to the lid, the hinge located adjacent to the void and to the nib.

2. The closure of claim 1, further comprising an annular outlet interposed between and in fluid communication with the opening in the base wall and the outlet, the annular outlet separating the opening in the base wall and the outlet by a predetermined distance.

3. The closure of claim 1 wherein the first skirt is threaded, such that the closure may be fixedly attached to a container neck.

4. The closure of claim 1 wherein a portion of the lid radially extends beyond the base wall when the lid is in a closed position.

5. The closure of claim 1, wherein the nib is substantially hemispherical.

6. The closure of claim 1, wherein the nib is formed substantially in the shape of a rectangular solid.

7. The closure of claim 1, wherein the living hinge includes only one section, and the nib is coupled to the lid wall substantially in front of the living hinge.

8. The closure of claim 1 wherein the first skirt further includes an annular bead, such that the closure may be snap-fit to a container neck.

9. The closure of claim 1 wherein a portion of the first skin and a portion of the base wall which is generally coextensive with the portion of the first skirt, both of which are substantially diametrically opposite to the living hinge, generally define a short chord.

10. The closure of claim 1 wherein the outlet defines a central axis and wherein the central axis is substantially perpendicular to the base wall so that the angle between the outer surface of the outlet and the base wall is substantially constant around the entire circumference of the frustal outlet.

11. The closure of claim 10 wherein the angle is approximately 30 degrees.

12. The closure of claim 1, wherein said hinge is a living hinge.

13. The closure of claim 12, wherein the living hinge includes two sections, one section on each of the opposite sides of the nib.

14. The closure of claim 1, wherein said outlet has a frustal shape.

15. The closure of claim 14 wherein the first skirt is threaded, such that the closure may be fixedly attached to a container neck.

16. The closure of claim 14 wherein a portion of the lid radially extends beyond the base wall when the lid is in a closed position.

17. The closure of claim 14, wherein the nib is substantially hemispherical.

18. The closure of claim 14, wherein the nib is formed substantially in the shape of a rectangular solid.

19. The closure of claim 14, wherein the living hinge includes only one section, and the nib is coupled to the lid wall substantially in front of the living hinge.

20. The closure of claim 14 wherein the first skirt further includes an annular bead, such that the closure may be snap-fit to a container neck.

21. The closure of claim 14 wherein a portion of the first skirt and a portion of the base wall which is generally coextensive with the portion of the first skirt, both of which are substantially diametrically opposite to the living hinge, generally define a short chord.

22. The closure of claim 14, further comprising an annular outlet interposed between and in fluid communication with the opening in the base wall and the frustal outlet, the annular outlet separating the opening in the base wall and the frustal outlet by a predetermined distance.

23. The closure of claim 22, wherein the annular outlet is coupled to a circumferential edge of the frustal outlet having the smallest diameter of the frustal outlet.

24. The closure of claim 14 wherein the frustal outlet defines a central axis and wherein the central axis is substantially perpendicular to the base wall so that the angle between the outer surface of the frustal outlet and the base wall is substantially constant around the entire circumference of the frustal outlet.

25. The closure of claim 24 wherein the angle is approximately 30 degrees.

26. A closure with a stay-open lid, comprising:

(a) a base including:

(i) a base wall having an opening thereon and an outer periphery;

(ii) a first skirt depending from the periphery of the base wall, having an outer edge formed at the juncture of the base wall outer periphery and the skirt;

(iii) an outlet coupled to the base wall and in fluid communication with the opening in the base wall;

(b) a lid connected to said base by a hinge, the closure having a void formed at the juncture of said outer edge and said hinge and at least partially within said hinge, said lid including:

(iv) a lid wall;

(v) a second skirt depending from the periphery of the lid wall;

(vi) a plug depending from the lid wall, the plug being received in the outlet when the lid is in a closed position;

(vii) a nib extending from an edge of the second skirt, the nib being received in the void when the lid is in a closed position on the base, and the nib frictionally engaging the sides of the void when the lid is in the open position, such that the lid is at least partially prevented from closing by the frictional engagement of the nib with the sides of the void.

* * * * *